US005347438A

United States Patent [19]

Lerner

[11] Patent Number: 5,347,438

[45] Date of Patent: Sep. 13, 1994

[54] COMBINED ILLUMINATION AND SAFETY LAMP

[76] Inventor: Robert A. Lerner, 836 Santa Fe Ave., Albany, Calif. 94706

[21] Appl. No.: 82,674

[22] Filed: Jun. 25, 1993

[51] Int. Cl.[5] ..... F21L 7/00

[52] U.S. Cl. ..... 362/186; 362/202; 362/363

[58] Field of Search ..... 362/363, 186, 277, 285, 362/188, 190, 202, 806, 362

[56] References Cited

U.S. PATENT DOCUMENTS

| | | | |
|---|---|---|---|
| 4,307,439 | 12/1981 | Sassmannshausen | 362/202 |
| 4,609,976 | 9/1986 | Geissler | 362/202 |
| 5,105,343 | 4/1992 | Wakimoto | 362/277 |

*Primary Examiner*—James C. Yeung
*Attorney, Agent, or Firm*—R. Russel Austin

[57] ABSTRACT

A lamp includes a bowl shaped reflector having an elongated aperture in its base for mounting a light source. A light source including a filament enclosed in a transparent envelope is mounted in the aperture such that when the light source is illuminated light is projected from the front of the reflector and also escapes through the aperture to the rear of the reflector. A lamp housing extending behind the reflector is transparent and includes a color filter material. Light projected from the front of the reflector provides light for illumination, while light escaping through the aperture in the reflector is transmitted through the color filter material and provides a safety signal.

19 Claims, 3 Drawing Sheets

COMBINED ILLUMINATION AND SAFETY LAMP

TECHNICAL FIELD OF THE INVENTION

The present invention relates generally to bicycle lamps. It relates in particular to a lamp which employs a single light-source to provide both white light for illumination and a colored safety light.

DISCUSSION OF BACKGROUND ART

A bicycle, when operated at night, is generally required to have a lamp for providing illumination by which a rider may see to operate the bicycle. It is usually also required to have a colored safety light, generally red, providing means by which the bicycle may be seen from the rear. Preferably, a safety light is also visible from the side of a bicycle.

Adding lights to a bicycle for night operation clearly will increase the weight of the bicycle. A cyclist may invest a substantial sum in a bicycle incorporating strong lightweight components made from materials such as aluminum and titanium alloys, and carbon fiber composites, for the purpose of minimizing the weight of the bicycle. Adding two or more lights to such a lightweight bicycle may add weight equivalent to brakes or a gear changing mechanism. As such the value of the investment in such lightweight components is somewhat reduced.

For off-road cycling, also referred to as mountain biking, it may be advantageous to provide lighting by means of a light attached to a rider's safety helmet. Safety helmets are now worn by a majority of cyclists as a matter of choice, rather than because of any law requiring their wearing. This is due at least in part to the development of extremely light helmets which provide little if any hindrance or discomfort to a wearer. Adding one or more lights to a helmet will significantly increase the weight of the helmet, making it uncomfortable for extended periods of wearing.

While lighting can not, realistically, be eliminated for night operation of bicycles, it would clearly be beneficial to reduce the total weight of a bicycle lighting system and would also be beneficial to provide a lightweight illumination and safety lighting system which could be helmet mounted.

SUMMARY OF THE INVENTION

It is an object of the present invention to reduce the weight and complexity of a bicycle lighting system, including a white light for illumination and a colored safety light or signal for visibility.

This and other objects of the invention are accomplished by combining the illumination and safety functions of a lighting system in a single lamp having only one light-source.

In a preferred embodiment of the invention, a lamp comprises a bowl-shaped reflector, having a reflective front surface and a back surface. The reflector has an aperture extending therethrough, at the apex of the reflector, for mounting a light-source on the reflector.

A light-source, such as an incandescent light-source, is mounted in the aperture. The light-source is enclosed in a transparent envelope. A filament portion of the envelope extends into the reflector, and a neck portion of the envelope extends through the aperture in the reflector beyond the back surface of the reflector.

A housing encloses the back surface of the reflector. At least a portion of the housing is transparent and includes a color filter material.

Electrical connection is made to the light-source by means of pins set in the neck portion of the light-source. In operation white light from the light-source is projected by the front surface of the reflector and provides light for illumination. Light from the light-source escapes at least down the neck portion of the light-source into the housing enclosing the back surface of the reflector. The escaping light is filtered by the color material to provide a color safety light of a predetermined color. The housing is preferably entirely transparent and entirely inclusive of color filter material. This provides that the colored safety light is visible from both the rear and from the side.

In one aspect of the present invention, the bowl shaped reflector of the lamp is preferably a molded glass reflector of a type generally referred to in the lighting industry by the letters MR followed by a number indicating the diameter of the reflector in one-eights of an inch. An MR11 for example has a diameter of about one-and-three-eighths of an inch ($1\frac{3}{8}$ in.), i.e., about thirty-five millimeters (35 mm). An MR16 has a diameter of about 2.0 in., i.e., about 51 mm.

Molded reflectors of the type described above are typically furnished with a multilayer interference filter coating on the front surface. The coating is configured to reflect visible light from the reflector and transmit heat through the reflector. Extending from the back surface of the reflector, at the apex thereof, is a light-source mounting portion. The aperture in the reflector extends through the first surface and completely through the light-source mounting portion. Typically, the light-source mounting portion has an "as molded" surface which is somewhat rough. The light-source mounting portion thus provides a diffuser for escaping light providing more uniform illumination of filter material in the housing.

In an MR-type molded reflector, the light-source mounting aperture, at the apex of the reflector, is generally an elongated rectangular aperture configured to accept a wide range of light-source types. Because of this, a light-source mounted in the aperture does not usually fill the aperture, thus leaving portions of the aperture extending beyond the light-source. This provides escape channels for light from the light-source.

Efficiency of use of escaping light may be enhanced by mounting the light-source in the aperture using a transparent adhesive.

A particularly useful feature of the present invention is that it utilizes light which in prior art lamps would simply be wasted by being absorbed in an opaque housing. Light which escapes behind a reflector, in particular an MR-type reflector, may be a substantial fraction of the total light generated by a light-source mounted in the reflector. The present invention is able to use this escaping light to provide a dual function illumination and safety light with only one light-source. Further, the dual function light may be operated with no more power or battery weight, than would be required to provide only the illumination function in a prior art lamp of similar power. A user is thus spared the capital cost, operating cost, and weight of separate illumination and safety lights.

BRIEF DESCRIPTION OF THE DRAWINGS

The accompanying drawings, which are incorporated in and constitute a part of the specification, schematically illustrate a preferred embodiment of the invention and, together with the general description given above and the detailed description of the preferred embodiment given below, serve to explain the principles of the invention.

DESCRIPTION OF PREFERRED EMBODIMENTS OF THE INVENTION

Figure 1:
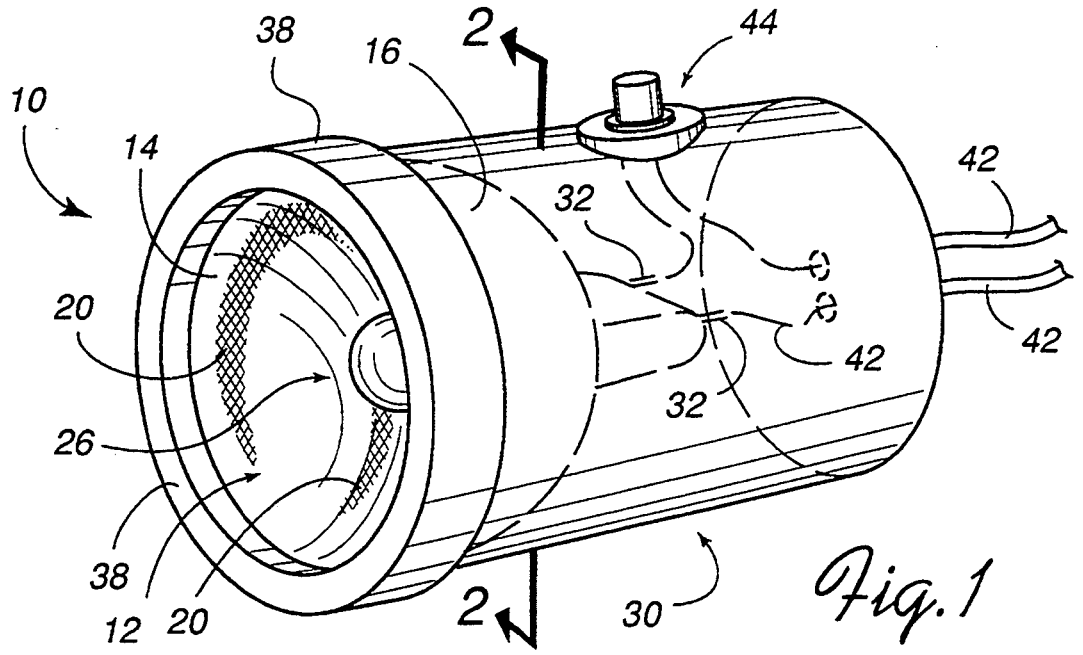
FIG. 1 is a perspective view schematically illustrating one embodiment of a lamp in accordance with the present invention.

The present invention is next described with reference to the drawings, wherein like components are designated by like reference numerals.

Figure 2:
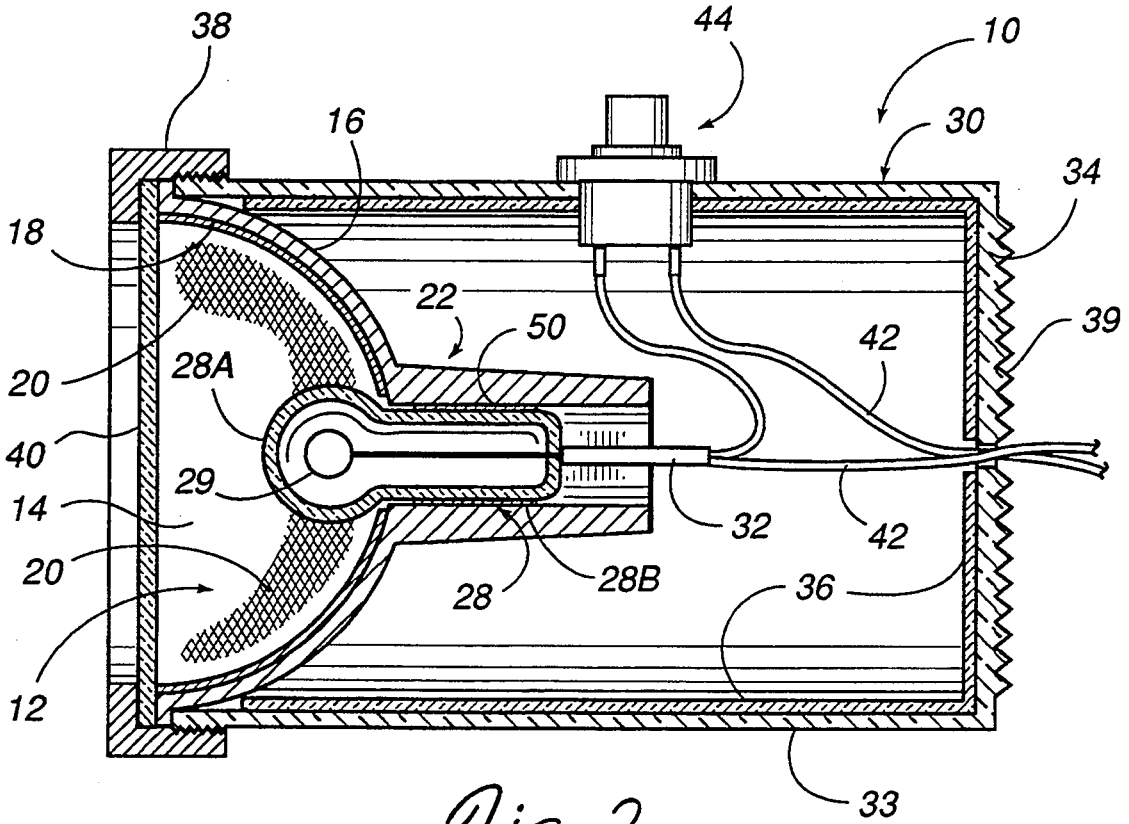
FIG. 2 is a cross section view seen generally in the direction 2—2 of FIG. 1 schematically illustrating details of the lamp of FIG. 1.
Figure 3:
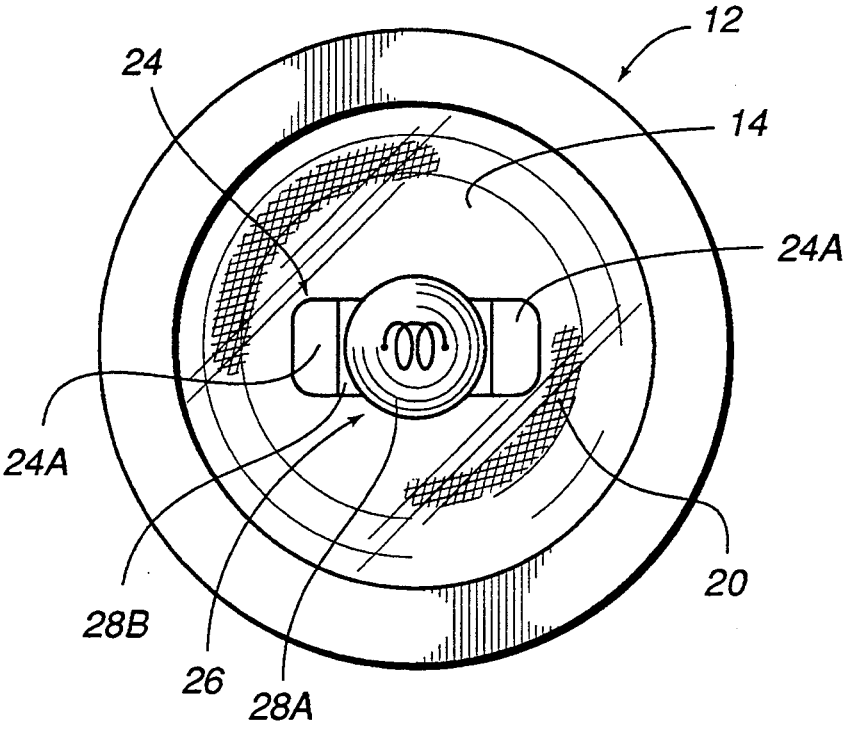
FIG. 3 is a cross section view seen generally in the direction 2—2 of FIG. 1 schematically illustrating the lamp of FIG. 1 including a self-contained power source.

Referring now to FIGS. 1, 2, and 3, one embodiment of a lamp 10 in accordance with the present invention includes a bowl-shaped reflector 12 having a concave reflective front surface 14 and a back surface 16, generally following the contour of the front surface.

As discussed above, reflector 12 is preferably a molded glass reflector of the type generally referred to in the lighting industry by the letters MR, followed by a number. The number following letters MR indicates the diameter of the reflector in one-eights of an inch. An MR11 for example has a diameter of about 1⅜ in., i.e., about 35 mm. An MR16 has a diameter of about 2.0 in., i.e., about 51 mm.

Reflectors of this type are produced by several major lighting companies in the United States, Europe and Japan. In the United States, for example, such reflectors are produced by The General Electric Company of Cleveland, Ohio. The reflectors are used extensively to produce low voltage high intensity lamps which are used for applications such as display lighting.

Molded reflectors of the type described above are typically furnished with a reflective coating 18 on front surface 12. The coating is usually a multilayer interference filter coating configured to reflect visible light from the reflector and transmit heat through the reflector. The front surface 14 of reflector 12 may be provided with facets 20 which help provide a uniform beam of illumination from lamp 10.

Extending from back surface 16 of reflector 12 at the apex thereof is a light-source mounting portion 22. An aperture 24 in the reflector (see FIG. 3) extends through the reflector at the apex thereof. In an MR-type reflector aperture 24 is generally an elongated, generally rectangular aperture configured to accept a range of suitable light-sources (bulbs). Aperture 24 extends through front surface 14 and through light-source mounting portion 22.

Mounted in aperture 24 is a light-source 26. Light-source 26 is preferably an incandescent light source such a a halogen cycle bulb. The light source 26 preferably includes an envelope 28 of glass or quartz including a filament portion 28A surrounding a filament 29, and a neck portion 28B enclosing leads or pins 32 for conducting current to filament 29.

Light-source 26 is mounted in aperture 24 with filament portion 28A extending beyond front surface 14 and with neck portion 28B extending beyond back surface and into light-source mounting portion 22 of reflector 12.

For an MR11 type reflector 12 a suitable light-source operates at about six Volts and draws between about five and twelve Watts of power. This type of light-source may be installed in aperture 24 leaving portions 24A of the aperture unoccupied by the light-source. An MR-11 type reflector complete with a halogen cycle bulb is available from the Thorn Company, of Enfield, England.

Continuing with reference to FIGS. 1 and 2, lamp 10 includes a housing 30 enclosing back surface 16 and light-source mounting portion 22 of reflector 12. At least a portion of housing 30 is transparent and includes a color filter material. Preferably substantially all of housing 30, including cylindrical wall 33 and base 34 (see FIG. 2), is transparent and includes a color filter material. Color filter material may be in the form of a separate sheet 36, for example, of transparent colored plastic. Alternatively, housing 30 may be molded from a transparent colored plastic material. Housing 30 is retained on reflector 12 by a screw cap 38. Screw cap 38 may also be used to secure a transparent cover 40 on reflector 12 for protecting light-source 26 and reflective front surface 14.

Wiring 42 connected to pins 32 provides means for connecting light-source 26 with a power source such as a battery, a generator, or a dynamo. A switch 44 may be mounted on housing 30 for turning lamp 10 on or off.

Figure 4:
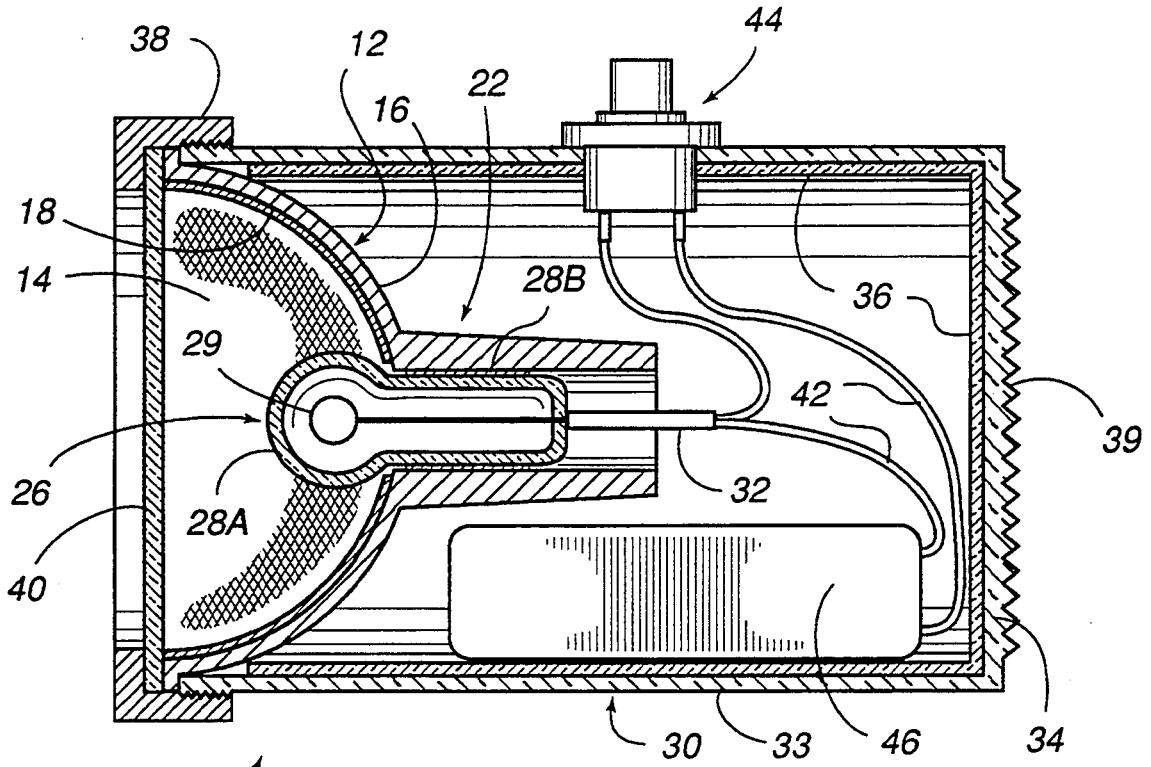
FIG. 4 is a side elevation schematically illustrating another embodiment of a lamp in accordance with present invention including a pattern of diffuse stripes on a fluorescent plastic housing.

Referring now to FIG. 4, lamp 10 may include a self contained power source such as a battery 46. This is practical in a lamp including incorporating an MR 16 type reflector wherein dimensions of housing 30 would be sufficient to accommodate an AA type battery.

When lamp 10 is turned on, i.e. when light-source 26 is illuminated, light from filament 30 radiates in all directions. Light from filament 29 which is incident on front surface 14 is reflected and projected forward and provides white light for illumination.

Light from filament 29 also "escapes" from reflector 12 by travelling down neck portion 28B of envelope 28 and by travelling down portions 24A of aperture 24 not occupied by light-source 26. Surprisingly, for lamps which are generally regarded as being compact and efficient, this escaping light may be between about five and twenty-five percent of light radiated from filament 29. In conventional MR-reflector-based lamps this escaping light is simply wasted, usually being absorbed as heat in opaque housings or lamp fixtures. The present invention, by providing a transparent housing enclosing back surface 16 of reflector 12, provides that this light may be used to illuminate a color filter material for providing a safety light function for lamp 10.

The signal lamp function of lamp 10 is improved if means are provided for diffusing escaping light, such that it more uniformly illuminates housing 30. In MR-type molded reflector, the light-source mounting portion often has an "as molded" surface which is somewhat rough. A rough surface on light-source mounting portion 22 provides a diffuser for escaping light. This provides more uniform illumination of filter material in the housing. In a reflector where light-source reflecting portion 22 is smooth or minimally rough, it may be roughened, for example by etching or sandblasting, to provide a diffuser.

Light-source 26 is preferably bonded in aperture 24 by a suitable adhesive 50. The adhesive is preferably transparent such that it does not absorb the escaping light, thus providing improved illumination for the safety light function of lamp 10. A silcone or epoxy based adhesive is preferred.

Figure 5:
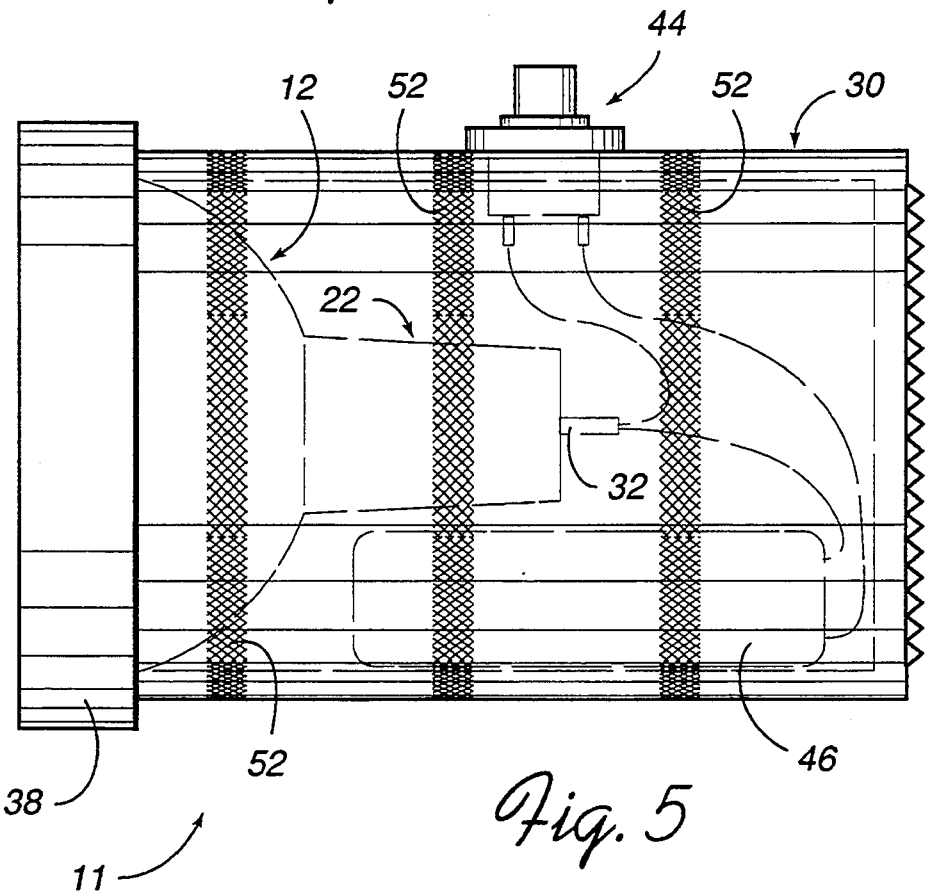
FIG. 5 is a front view schematically illustrating a light-source mounted in a molded glass reflector for a lamp in accordance with the present invention.

Referring now to FIG. 5, in another embodiment 11 of the present invention all or a portion of housing 30 may include, or may be formed from, a transparent colored fluorescent plastic filter material such as "LISA BRAND" available from Miles Corporation, of Berlin, Conn. Such a material has the property of apparently trapping fluorescence generated when it is illuminated. Trapped fluorescence appears to be concentrated at roughened portions of the material, causing the fluorescence to appear particularly bright. In a housing 30 constructed from such fluorescent plastic material, roughened areas 52 may be disposed thereon in a predetermined pattern to enhance emission of fluorescence from the material.

The present invention has been described primarily in terms of a molded glass MR-type reflector. As discussed above this type of reflector conveniently provides certain function elements of the present invention, for example, waste light collection and diffusion, in a reflector which is already manufactured in volumes of millions of units per year, world wide. Because of the existing sales volume and diversity of suppliers, these reflectors are relatively inexpensive. Because of this a lamp of the present invention may be made relatively inexpensively even in modest production volumes.

Those having skill in the art may take advantage of the description of the invention given above to devise other reflector and diffuser configurations operable within the scope and spirit of the present invention.

Reflector 12 may be other than an MR-type reflector described above. For example it may be spun or electroformed from a metal or molded from a plastic material without departing from the spirit of the present invention.

Reflective front surface 14 of reflector 12 may be provided by a metal reflective coating rather the multilayer filter coating normally supplied with MR-type reflectors. A portion of reflective coating may be removed or omitted around aperture 24 to increase the proportion of light escaping from reflector 12.

Diffusion of escaping or waste light may be accomplished by providing a faceted surface 39 (see FIGS. 2 and 4) on one or more transparent portions of housing 30.

It will also be evident that housing 30 of lamp 10 need not be limited to a cylindrical form as described above but may be made in other forms, for example, for enhancing aerodynamics, for providing expanded space or compartments for battery storage, for providing a preferred viewing orientation for the safety light, or for providing an integral mounting bracket.

Methods of mounting lamps on a bicycle or on a helmet are well known to those familiar with the art. A description of such mounting methods is not necessary for understanding principles of the present invention, and accordingly is not presented here. It will be appreciated that, for helmet mounting, in particular the potential for lightweight and compactness of the lamp makes it adaptable to mounting by either conventional mechanical means using clip or screw fasteners, or by means of hook-textured closure materials such as "DUALOCK" available form the 3M Corporation of St Paul, Minn.

The present invention has been described in terms of a preferred embodiment and a number of other embodiments. The invention however is not limited to the embodiments described and depicted. Rather, the scope of the invention is defined by the appended claims.

What is claimed is:

1. A lamp, comprising:

a bowl-shaped reflector, said reflector having a concave reflective front surface a back surface and an apex;

said reflector having an aperture extending therethrough at the apex thereof for mounting a light-source therein;

a housing enclosing said back surface of said reflector, at least a portion of said housing being transparent and including a color filter material;

a light-source mounted in said aperture, said light-source including a filament enclosed in a transparent envelope; and said transparent envelope having a filament portion thereof extending beyond said front surface into said reflector and a neck portion thereof extending through said aperture beyond said back surface of said reflector, whereby a first portion of light from said incandescent light-source may escape via said neck portion of said transparent envelope through said aperture into said housing for illuminating said color filter material, thereby providing a color safety signal.

2. The lamp of claim 1 further including means for diffusing light escaping through said aperture into said housing.

3. The lamp of claim 1 further including a transparent cover mounted in front of said reflector for protecting said reflective surface.

4. The lamp of claim 3 further including means for connecting said light-source to an electrical power source.

5. The lamp of claim 4 wherein said power source is a battery mounted within said housing.

6. The lamp of claim 1 wherein said color filter material is a fluorescent plastic color filter material.

7. The lamp of claim 6 wherein at least a portion of said color filter material is diffuse for enhancing emission of light therefrom.

8. The lamp of claim 1 wherein said light-source is mounted in said aperture with a transparent adhesive material.

9. The lamp of claim 1 wherein said aperture has an elongated rectangular configuration, said rectangular configuration defining an open space between said transparent envelope of said light-source and said reflector, such that a second portion of light from said incandescent light-source may escape via said open space into said housing.

10. A lamp, comprising:

a bowl-shaped molded glass reflector, said reflector including a concave front surface having a reflective coating thereon, a back surface, an apex, a light-source mounting portion extending from said back surface at the apex of said reflector, and an elongated rectangular aperture extending through said front surface and through said light-source mounting portion;

a housing enclosing said back surface of said reflector and said light-source mounting portion of said reflector, at least a portion of said housing being transparent and including a color filter material;

an incandescent light-source mounted in said aperture, said light source including a filament enclosed in a transparent envelope, said envelope having a filament portion and a neck portion; and said filament portion extending beyond said first surface into said reflector, said neck portion extending through said aperture into said light-source mounting portion and attached thereto, and said neck portion arranged in said rectangular aperture to define an open space between said transparent envelope and said reflector whereby a first portion of light from said light-source escapes via said neck portion of said transparent envelope through said aperture into said housing, and a second portion of light from said light source escapes via said open space through said aperture into said housing, said escaping light for illuminating said color filter material, thereby providing a colored safety signal.

11. The lamp of claim 10 further including means for connecting said light-source to an electrical power source.

12. The lamp of claim 11 further including switch means, mounted on said housing.

13. The lamp of claim 10 wherein said color filter material is a fluorescent filter material.

14. The lamp of claim 13 wherein at least a portion of said color filter material is diffuse for enhancing emission of light therefrom.

15. The lamp of claim 10 wherein said light-source is mounted in said aperture with a transparent adhesive material.

16. The lamp of claim 10 wherein said aperture is elongated and extends beyond said light-source mounted therein.

17. The lamp of claim 10 further including means for diffusing said light escaping into said housing.

18. The lamp of claim 17 wherein said diffusing means is provided by said light source mounting portion of said reflector.

19. The lamp of claim 17 wherein said diffusing means includes a faceted surface on at least a portion of said transparent portion of said housing.

* * * * *